United States Patent [19]

Hall et al.

[11] Patent Number: 5,010,745

[45] Date of Patent: Apr. 30, 1991

[54] HIGH SECURITY POST LOCK

[75] Inventors: Charles E. Hall, Salem; Stevie C. Roop, Dugspur, both of Va.

[73] Assignee: Medeco Security Locks, Inc., Salem, Va.

[21] Appl. No.: 388,495

[22] Filed: Aug. 2, 1989

[51] Int. Cl.[5] ..... E05B 67/36

[52] U.S. Cl. ..... 70/32; 70/379 R; 70/34

[58] Field of Search ..... 70/2, 6, 11, 31-33, 70/379 R-380; 292/226, 236

[56] References Cited

U.S. PATENT DOCUMENTS

| | | | |
|---|---|---|---|
| 1,912,663 | 6/1933 | Shinn | 70/33 |
| 2,275,362 | 3/1942 | Golden et al. | 70/379 R X |
| 2,677,261 | 5/1954 | Jacobi | 70/32 X |
| 2,837,908 | 6/1958 | Segal | 70/379 R X |
| 3,423,971 | 1/1969 | Brunelli | 70/231 |
| 3,817,062 | 6/1974 | Randel | 70/32 X |
| 4,022,486 | 5/1977 | Plaiss | 70/379 R X |
| 4,688,405 | 8/1987 | Epstein | 70/14 |
| 4,829,798 | 5/1989 | Roop | 70/379 R |

FOREIGN PATENT DOCUMENTS

| | | | |
|---|---|---|---|
| 1531640 | 5/1968 | France | 70/379 R |
| 526953 | 3/1955 | Italy | 70/379 R |
| 855474 | 11/1960 | United Kingdom | 70/379 R |

*Primary Examiner*—Gary L. Smith
*Assistant Examiner*—Suzanne L. Dino
*Attorney, Agent, or Firm*—Bernard, Rothwell & Brown

[57] ABSTRACT

A high security post lock according to the invention includes a hardened shell having a head member at one end thereof and an eccentric locking cam rotatably mounted at the other end. The lock is adapted to be inserted through an opening passing through a door frame and a door to secure the door. In a first or open position, the circumference of the cam is coextensive with the circumference of the shell, so that the lock can be inserted into and withdrawn from the door. In a second or locked position, the locking cam projects outwardly from the shell to prevent withdrawal of the lock and thus secure the door. Movement of the cam is limited by a pin and groove arrangement.

7 Claims, 3 Drawing Sheets

HIGH SECURITY POST LOCK

BACKGROUND OF THE INVENTION

1. Field of the Invention

This invention relates to improvements in high security post locks, and particularly to such devices which, for example, are adapted to pass through a movable door and its associated door frame.

2. Background Art

Medeco Security Locks, Inc., the assignee of the present invention, is well known for its high security locking devices. Medeco® locks are famous for their resistance to picking and drilling by virtue of their advanced twisting offset tumbler mechanical design and use of hardened steel components.

High security post locks, e.g. those for rolling or retractable garage doors and store fronts, have posed special problems. In general, it is desired to prevent movement of the rolling door relative to the frame by securing the door and frame together. While locks including a shaft terminating in a cam or other style protrusion are known, their designs have not rendered them truly suitable for the highest security applications. For example, many such designs cannot provide two-way security; i.e., both sides of the door cannot be secured against opening with a single lock.

U.S. Pat. No. 4,688,405 to Epstein, Aug. 25, 1978, illustrates a "concealed post lock" adapted to pass through a rolling door in order to secure the door to the door frame. The post lock includes a shaft passing through the door frame and the door, with an eccentric locking member rotatably mounted at the free end of the shaft. The locking member prevents the lock from being withdrawn from the door and frame.

The design of the Epstein post lock presents several disadvantages, however. The rotation of the eccentric relative to the post is limited by a shoulder projecting from the end of the post. The shoulder engages a corresponding flange on the eccentric, and the mating surfaces therebetween are exposed to the external environment. Debris collecting between the mating surfaces can be a source of friction and inhibit free operation of the lock, and could jam the lock and prevent its extraction. The lock cylinder and the shank of the eccentric are disposed in offset bores in the post, and are joined by a single locking pin. This arrangement introduces an inherent weakness into the device as well as manufacturing and assembly complexities with associated expenses.

U.S. Pat. No. 2,677,261 to Jacobi, May 4, 1954, relates to a door handle lock having a reduced diameter stem which passes through the door handle and into the door frame. A shaft passing through the stem terminates in a hook portion for preventing withdrawal of the lock.

U.S. Pat. No. 3,423,971 to Brunelli, Jan. 28, 1969, illustrates an automobile wheel lock. A locking rotatable cam element secures the lock over one of the lug nuts to prevent removal of the wheel.

A continuing need exists for a high security post lock of the type used for securing rolling or retractable-type doors. For highest security applications, the locking device should secure the door against opening from both sides and should be highly resistant to picking, drilling and other forms of tampering.

SUMMARY OF THE INVENTION

The present invention fulfills the needs discussed above by providing a high security locking device including a shell passing through a hole provided in the door frame and the door. When inserted through the frame and door, the shell prevents relative movement between the two. A head member is secured to a first end of the shell and acts as a stop as the lock is inserted. A locking cam is rotatably mounted to a locking cylinder at the second end of the shaft (remote from the head end) and, when locked in its displaced configuration, projects outwardly from the shell to prevent withdrawal of the lock.

Rotation of the locking cam relative to the shell is governed by a pin and groove arrangement. In a preferred embodiment, the locking cam includes a pin which rides in a corresponding arcuate groove in the end of the shell.

A novel eccentric construction of the locking cam and actuator permits the locking cylinder to be housed within a single, longitudinal bore within the shell, thereby maximizing the cylinder's resistance against tampering. This eccentric construction includes the longitudinal bore being eccentric within the shell and the locking cam being mounted eccentric to the bore. The design of the cam and the center of its rotation presents a relatively large surface area to the frame of the door, aiding in compensating for oversize and/or misaligned mounting holes and surfaces.

BRIEF DESCRIPTION OF THE PREFERRED EMBODIMENTS

Figure 1:
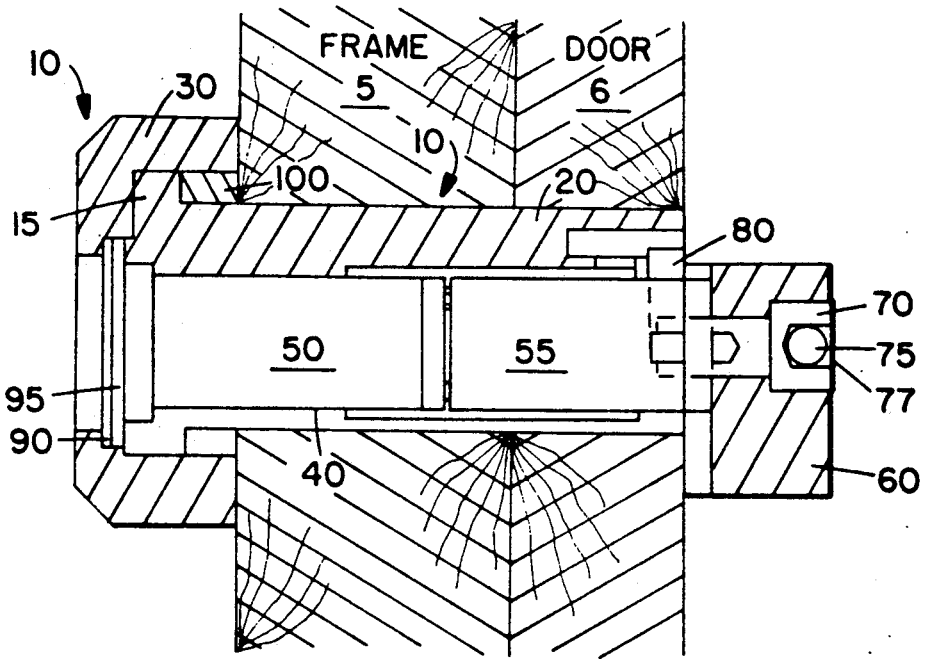
FIG. 1 is a sectional elevational view of a high security post lock according to the present invention.

As seen in FIG. 1, the high security post lock of the present invention (designated generally by the reference numeral 10) includes a shell 20. The lock is adapted to be inserted through a door frame 5 and door 6. A protector cap forming an enlarged head 30 is fixed to a first flanged end 15 of the shell and abuts the door frame 5.

Figure 2:
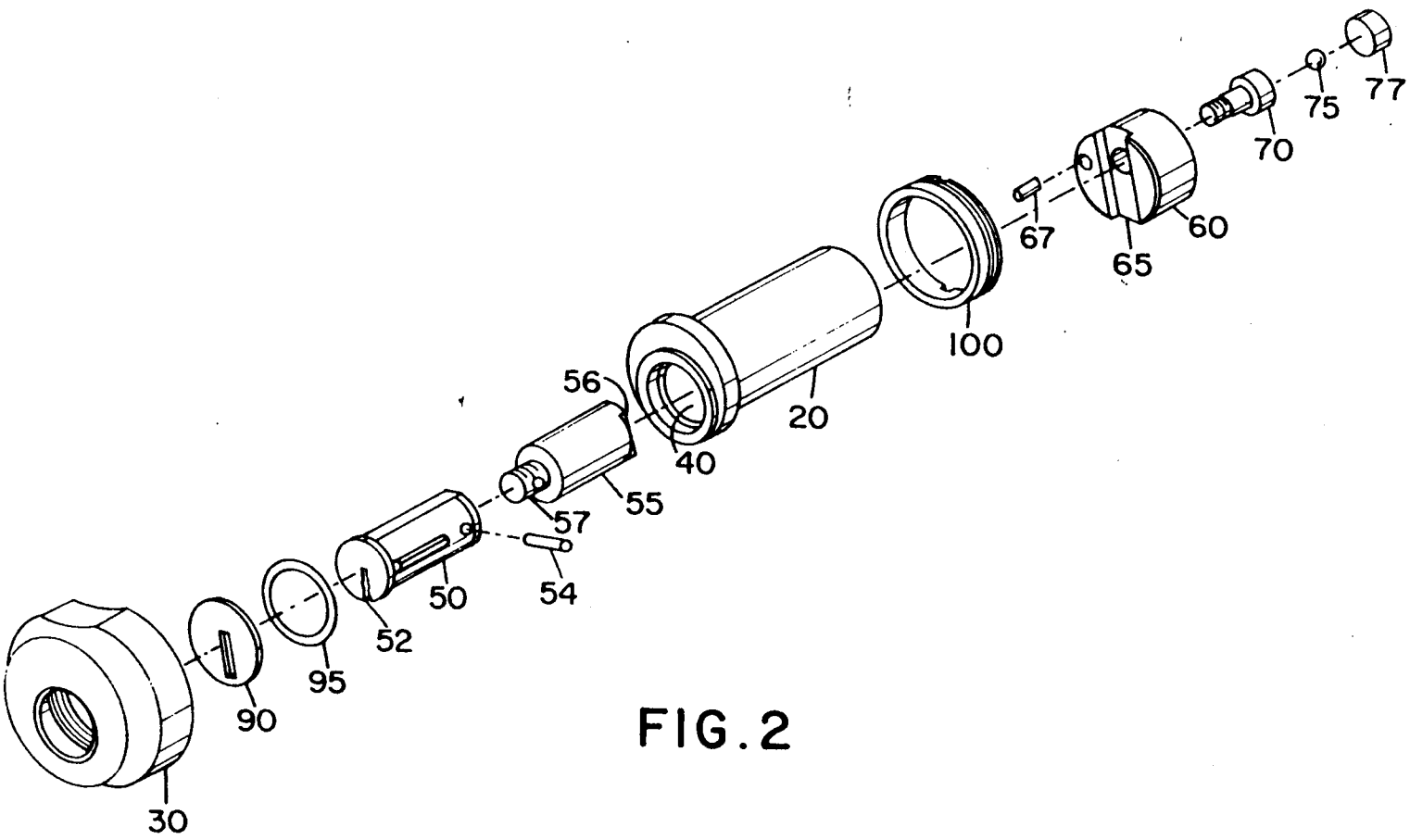
FIG. 2 is an exploded view of the lock illustrated in FIG. 1.

A single, longitudinal bore 40 is eccentrically disposed with respect to the shell 30 and extends therethrough; that is, the central axis of bore 30 is parallel to but offset from the central axis of shell 30. Bore 40 houses a lock actuator assembly which is schematically illustrated in FIGS. 1 and 2. The actuator assembly of this preferred embodiment includes a locking cylinder 50 with an extension cylinder 55 affixed thereto. In other embodiments, however, the overall length of either locking cylinder 50 or shell 20 could be selected so as to avoid the need for the extension cylinder.

The locking cylinder 50 employed in the present invention preferably is a twisting tumbler Medeco® cylinder. "Medeco®" means locks manufactured by Medeco Security Locks, Inc. of Salem, Va., and as shown for example in U.S. Pat. Nos. 3,722,240, Re. 30,198 and 4,635,455 which are incorporated herein by reference. In view of the well-known construction of the Medeco locking cylinders, components which are not changed in this invention will not be described in great detail.

With reference to FIGS. 1 and 2, locking cylinder 50 is rotatably mounted within the eccentric longitudinal bore 40 of shell 20. The cylinder has a keyway 52 of desired configuration to accommodate a key (not shown) having the same sectional configuration as the keyway. When a properly bitted key is inserted into the keyway, the tumblers are aligned in a manner which permits the locking cylinder to rotate within the bore 40 of shell 20 as is well known in the art.

In the illustrated embodiment, the inner end of the locking cylinder (that is, the end opposite from the keyway) has been fitted with an extension cylinder designated 55. The extension cylinder includes a threaded shaft 57 which engages a corresponding bore in the rearward end of the locking cylinder. The extension is fixed by pin 54 and/or an adhesive (e.g. Loctite® brand) so that the cylinder and extension function as a unitary element when assembled. This arrangement permits a single style and size of locking cylinder to be adapted for use in locks of a variety of lengths simply by coupling the cylinder with an appropriately sized extension. The manufacture and stocking of extensions of various lengths is far more efficient than the manufacture and stocking of fully functional cylinders of varying lengths.

High security against drilling is provided by a hardened key slot protector plate 90 which, along with spacing washer 95, is placed over the front-facing surface of the locking cylinder keyway within head 30.

A locking cam 60 is mounted to the rearward end of the lock actuator assembly so that it is free to rotate therewith. In this embodiment locking cam 60 is secured to the rearward end of the extension cylinder 55 by recessed screw 70. As seen best in FIG. 2, the locking cam 60 includes a groove 65 which is configured to mate with the corresponding rearward portion of the extension cylinder. A ball bearing 75 has been inserted and fixed within the head of the screw to provide additional security against surreptitious disassembly of the lock. The screw head and ball are concealed by cap 77.

Figure 3:
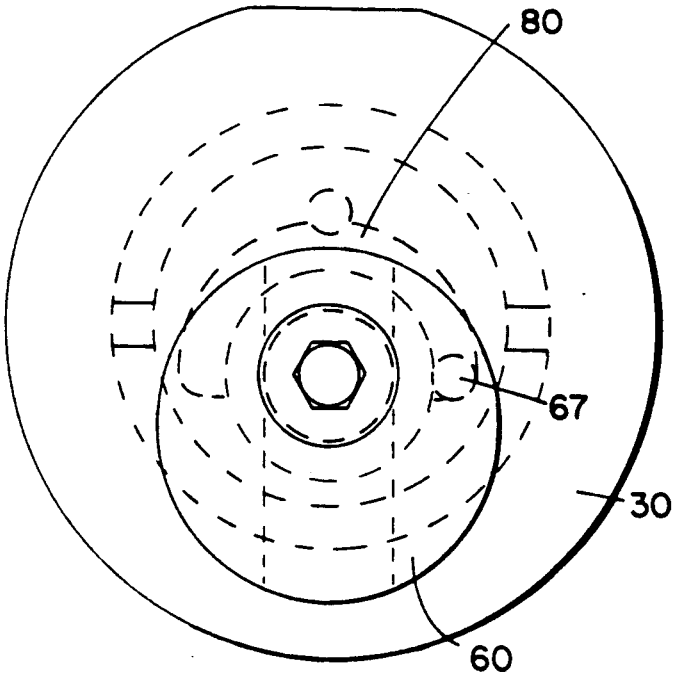
FIG. 3 is an end view of the lock illustrated in FIGS. 1 and 2.

The extent of available rotation of the cylinder/locking cam assembly within the lock is governed by a pin and groove arrangement as seen in FIG. 3. The rearward end of shell 20 includes an arcuate, recessed groove 80, the groove having an arc length of less than 360° and preferably an arc length of about 180°. The locking cam 60 carries a pin 67 which rides in groove 80 as the cylinder and cam are rotated. The terminations of groove 80 serve to limit the rotation of the cam, and hence the cylinder assembly, between a first position wherein the cam is coextensive with the shell (and the lock is "open", i.e. the lock can be pulled out) and a second position wherein the cam projects outwardly from the shell (and the lock is "closed"). Also seen in FIG. 3 is the threaded locking ring which secures shell 20 within head 30.

The operation of the present high security post lock should now be readily apparent. From its open configuration, the lock is inserted into the frame and through a door to be secured. A properly bitted key is inserted into the keyway, thereby freeing the locking actuator assembly for rotation within the longitudinal bore of the shell. The actuator assembly and thus the locking cam are rotated 180° as the pin on the cam rides within the arcuate groove in the shell. At this point the locking cam projects from the shell so that the lock cannot be withdrawn. For locking the opposite procedure may be followed.

Figure 4:
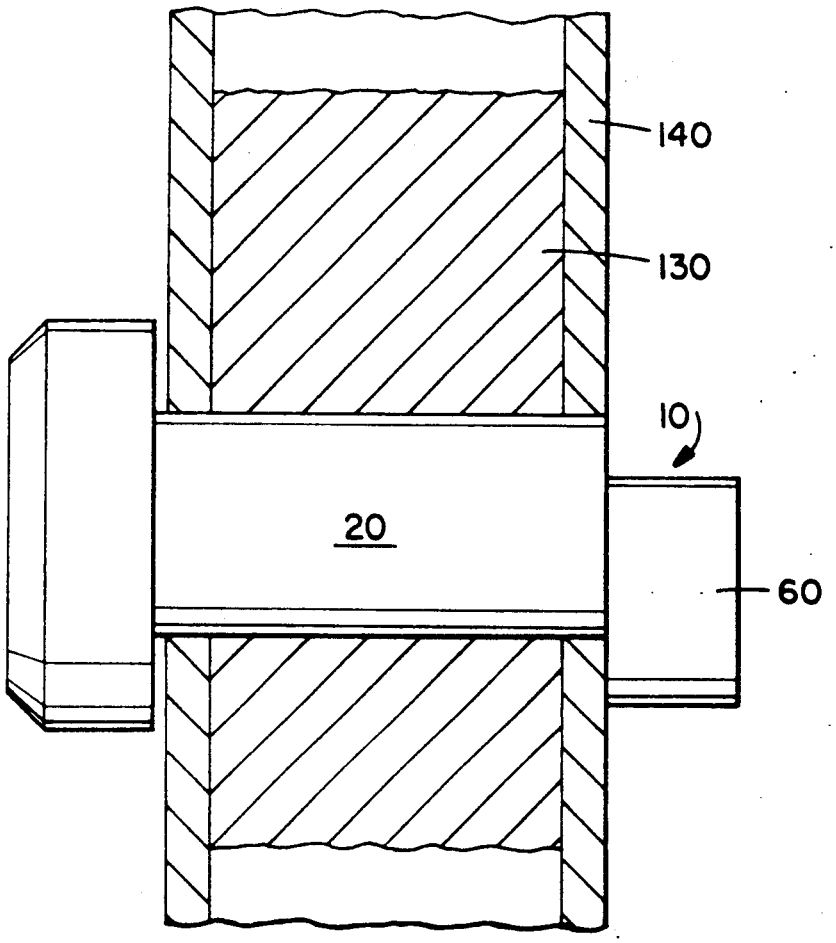
FIG. 4 is a sectional elevational view of an installation of the present lock.

FIG. 4 illustrates another type of installation for the present post lock. In this Figure, the lock 10 secures a door 130 which slides along a channel-type track 140. The shell 20 of the lock passes through aligned holes drilled through the door and the track, and rotation of the ca 60 into the illustrated locked position prevents withdrawal of the lock.

The present high security post lock thus overcomes the disadvantages of prior locks. Locks of a variety of lengths are able to utilize a common high security cylinder. The mechanical design of the lock is uncomplicated, thus providing a reliable yet highly secure device which is relatively inexpensive to manufacture. The components are of relatively simple shape and are few in number. The pin and groove arrangement, which limits rotation of the cam, is concealed by the cam to help avoid the gathering of debris which could jam the lock.

Although the present invention has been described in this preferred embodiment, it is not so limited. Variations and equivalents will be apparent to those skilled in the art. For example the arcuate groove could be provided in the locking cam, with the corresponding pin being provided on the rear end of the shell.

We claim:

1. A high security post lock of the type including;

a shell means for passing through a door and securing the door against undesired movement;

a head member disposed at a first end of said shell means;

a locking cam rotatably mounted at a second end of said shell means and moveable from a first position wherein the cam is coextensive with the shell means to a second position wherein the cam projects outwardly from the shell means;

and a lock actuator means housed within the shell means and in engagement with the head member and the locking cam for selectively securing the locking cam against rotation;

with improvements in control of the locking cam wherein rotation of the locking cam relative to the shell is limited by a pin movable in an arcuate groove, the pin and groove being on facing portions of the shell means and locking cam.

2. A high security post lock according to claim 1 wherein the arcuate groove is disposed in the second end of the shell means the pin projects from an adjacent face of the locking cam.

3. A high security post lock according to claim 1 wherein the head member, shell means, locking actuator means and locking cam each have a central axis, the central axes of the head member and of the shell means are co-linear and offset from the central axis of the lock actuator means and the central axis of the locking cam, and the locking cam means is eccentrically rotatable along the central axis of the lock actuator means.

4. A high security post lock according to claim 1 wherein the lock actuator means is housed within a single longitudinal bore within the shell means.

5. A high security post lock according to claim 1 wherein the arcuate groove has an arc length of about 180°.

6. A high security post lock of the type including:

a shell means for passing through a door and securing the door against undesired movement;

a head member disposed at a first end of said shell means;

a locking cam mounted at a second end of said shell means and movable from a first position where the cam is coextensive to the shell means to a second position where the cam projects outward of the shell means; and a lock actuator means housed within the shell means in engagement with the head member and the locking cam means for selectively securing the locking cam against rotation;

with improvements in control of the locking cam wherein rotation of the locking cam relative to the shell is limited by a pin movable in an arcuate groove, the pin and groove being on facing portions of the shell means and locking cam, the arcuate groove being disposed in the second end of the shell means and the pin projecting from an adjacent face of the locking cam, the head member shell means, lock actuator means, and locking cam having a central axis, the central axes of the head member and the shell means being co-linear and offset from a central axis of the lock actuator means and the central axis of the locking cam, the locking cam being eccentrically rotatable along the central axis of the lock actuator means, the lock actuator means being housed within a single longitudinal bore within the shell means, and wherein the lock actuator means comprises a lock cylinder and an extension cylinder.

7. A high security post lock comprising:

a lock shell having an enlarged head on one end, a locking cylinder positioned within a longitudinal bore eccentrically disposed on the shell, a lock actuator assembly actuated by the lock cylinder, with improvements in the lock actuator assembly comprising: a locking cam rotatable with the lock cylinder, a recessed groove in the end of the shell opposite the enlarged head, the groove having an arc-length less that 360°, a pin projecting from the locking cam and disposed in the arcuate groove, terminations of the groove serving to limit rotation of the cam so that on operation of the lock the cam projects eccentrically from the surface of the cylinder for locking purposes.

* * * * *